US011918844B2

(12) United States Patent
Davis

(10) Patent No.: US 11,918,844 B2
(45) Date of Patent: Mar. 5, 2024

(54) EXERCISE BACKPACK AND METHODS OF USE

(71) Applicant: Timothy Davis, Old Bridge, NJ (US)

(72) Inventor: Timothy Davis, Old Bridge, NJ (US)

( * ) Notice: Subject to any disclaimer, the term of this patent is extended or adjusted under 35 U.S.C. 154(b) by 0 days.

(21) Appl. No.: 18/054,897

(22) Filed: Nov. 12, 2022

(65) Prior Publication Data

US 2023/0075392 A1 Mar. 9, 2023

Related U.S. Application Data

(63) Continuation of application No. 17/473,711, filed on Sep. 13, 2021, now Pat. No. 11,524,203.

(60) Provisional application No. 63/078,852, filed on Sep. 15, 2020.

(51) Int. Cl.

| | |
|---|---|
| ***A63B 21/00*** | (2006.01) |
| ***A45F 3/04*** | (2006.01) |
| ***A63B 21/04*** | (2006.01) |
| ***A63B 21/055*** | (2006.01) |
| ***A63B 21/065*** | (2006.01) |
| ***A63B 71/00*** | (2006.01) |
| *A45F 3/00* | (2006.01) |
| *A45F 3/16* | (2006.01) |

(52) U.S. Cl.

CPC ..... *A63B 21/4007* (2015.10); *A45F 3/04* (2013.01); *A63B 21/0442* (2013.01); *A63B 21/0552* (2013.01); *A63B 21/065* (2013.01); *A63B 21/4035* (2015.10); *A63B 71/0036* (2013.01); *A45F 2003/003* (2013.01); *A45F 2003/045* (2013.01); *A45F 2003/166* (2013.01)

(58) Field of Classification Search

CPC ..... A63B 21/4007; A63B 21/0442; A63B 21/0552; A63B 21/065; A63B 21/4035; A63B 71/0036; A63B 21/00061; A63B 23/03541; A63B 21/153; A63B 23/1209; A45F 3/04; A45F 2003/003; A45F 2003/045; A45F 2003/166

See application file for complete search history.

(56) References Cited

U.S. PATENT DOCUMENTS 4,961,573 A * 10/1990 Wehrell ..... A63B 21/4007 482/124
5,167,600 A * 12/1992 Baird ..... A63B 21/065 482/93
5,618,249 A * 4/1997 Marshall ..... A63B 21/4001 482/92
5,792,034 A * 8/1998 Kozlovsky ..... A63B 21/4009 482/124
5,916,070 A * 6/1999 Donohue ..... A63B 21/151 482/114
6,216,926 B1 * 4/2001 Pratt ..... A45F 3/04 224/655
6,280,365 B1 * 8/2001 Weber ..... A63B 21/4001 482/124
6,659,921 B2 * 12/2003 Vernon ..... A63B 23/03508 482/114

(Continued)

*Primary Examiner* — Andrew S Lo

(74) *Attorney, Agent, or Firm* — SLEMAN & LUND LLP

(57) ABSTRACT

A training device includes a backpack having a pair of shoulder straps, a rigid backbrace having at least two arms, a pair of lower support members coupled to ends of the rigid backbrace, and a resistance band coupled to each of the pair of lower support members and terminating in a handle.

13 Claims, 3 Drawing Sheets

(56) References Cited

U.S. PATENT DOCUMENTS

| | | | | |
|---|---|---|---|---|
| 7,297,090 | B2 * | 11/2007 | Torres | A63B 21/4009 482/127 |
| 9,345,942 | B2 * | 5/2016 | Stevens | A63B 69/18 |
| 10,702,047 | B1 * | 7/2020 | Younan | A63B 21/0722 |
| 11,285,356 | B2 * | 3/2022 | Marti | A63B 21/065 482/93 |
| 2011/0183819 | A1 * | 7/2011 | Pharoe | A63B 21/4025 482/105 |
| 2014/0309089 | A1 * | 10/2014 | Buikema | A63B 21/0004 482/105 |
| 2015/0031007 | A1 * | 1/2015 | Ruiz | A63B 69/18 434/253 |
| 2019/0022452 | A1 * | 1/2019 | Tedesco | A63B 21/0552 |
| 2021/0268326 | A1 * | 9/2021 | Kelly | A63B 21/4005 |

* cited by examiner

EXERCISE BACKPACK AND METHODS OF USE

CROSS-REFERENCE TO RELATED APPLICATIONS

The present disclosure is a continuation of U.S. patent application Ser. No. 17/473,711, filed Sep. 13, 2021, which claims priority to U.S. Patent Application Ser. No. 63/078,852, filed Sep. 15, 2021, the disclosure of which is hereby incorporated in its entirety as if fully set forth herein.

FIELD OF THE DISCLOSURE

The present disclosure relates to devices and methods for exercising. More specifically, the present invention relates to devices that can be worn to allow for mobile resistance training.

BACKGROUND OF THE DISCLOSURE

Exercise equipment is typically large and require the user to go to a designated gym or room to train. Additionally, exercise equipment can be expensive, and users may require several different machines, each machine being limited to training a given muscle. Thus, it would be beneficial to make an affordable, mobile training device that has robust capability and can be used to perform different exercises.

SUMMARY OF THE DISCLOSURE

In some embodiments, a training device includes a backpack having a first compartment for storage, and a second compartment for hydration, a pair of diagonal braces configured and arranged to accept a number of free weights, a pair of lower support members coupled to ends of the diagonal braces, a spool coupled to each of the lower support members and pivotable and translatable relative thereto, and a resistance band coupled to each spool and terminating in a handle.

BRIEF DESCRIPTION OF THE DISCLOSURE

Various embodiments of the presently disclosed training devices are disclosed herein with reference to the drawings, wherein.

FIGS. 2A-D are schematic representations of a second embodiment of the training device.

Various embodiments of the present invention will now be described with reference to the appended drawings. It is to be appreciated that these drawings depict only some embodiments of the disclosure and are therefore not to be considered limiting of its scope.

DETAILED DESCRIPTION

Despite the various improvements that have been made to exercise equipment, conventional devices and methods suffer from certain shortcomings such as those discussed above. There therefore is a need for further improvements to the devices and methods used for exercising. Among other advantages, the present disclosure may address one or more of these needs.

Figure 1A:
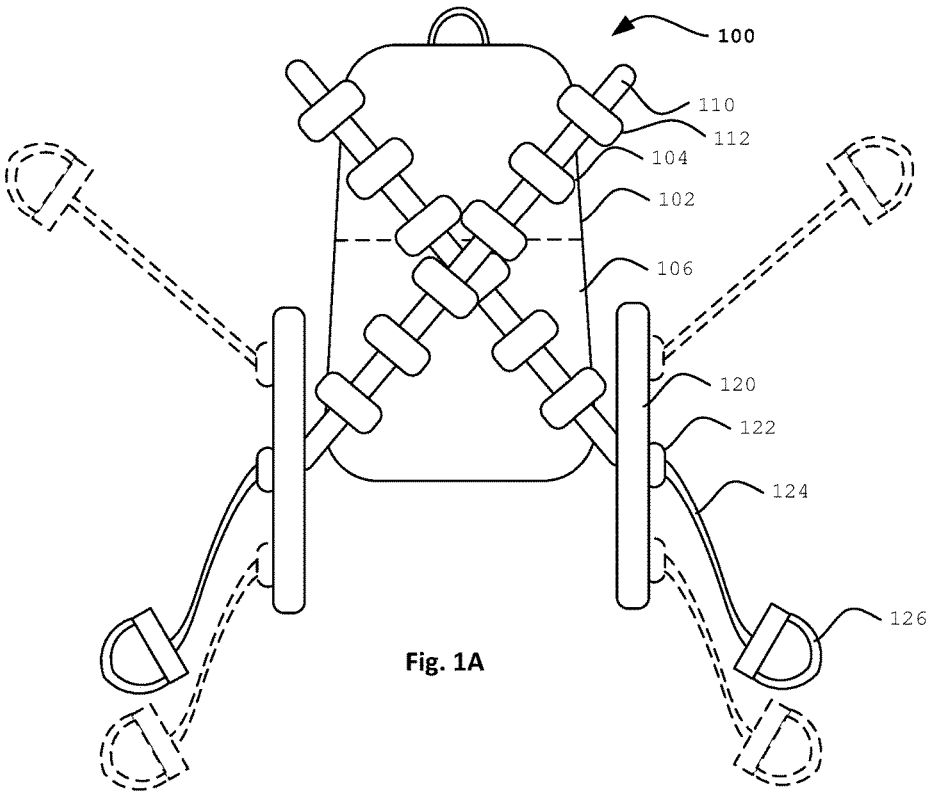
FIG. 1A is a schematic front view of the training device according to one embodiment.

FIG. 1A illustrates an exercise device 100 in the form of a wearable backpack 102. Backpack 102 may have two separate compartments including an upper storage compartment 104 and a lower hydration compartment 106 that can hold water, juice or other drinks. A pair of back braces 110 made of a metal or a rigid plastic may extend diagonally across the backpack and form an X-shaped brace. Braces 110 may be unitarily formed or otherwise coupled to one another. Each of the braces 110 may have a track or receptacle configured to mate with coupleable free weights 112, which may be added onto the braces 110 to increase the weight of the training device or the level of difficulty.

A lower support member 120 may be coupled to lower ends of each of the braces 110. In this example, lower support members are coupled to the lower end of braces 110 at midpoints of the lower support members. As shown, a moveable spool 122 may be coupled to lower support members 120, the moveable spool 122 being capable of translating along the lower support members to various positions along the lower support member. In this example, spools 122 may be disposed along any point of lower support member and locked in place via pins or other similar techniques. In at least some examples, lower support member 110 includes multiple telescoping components that adjust the length of the lower support member, and with it, the position of the spools.

Figure 1B:
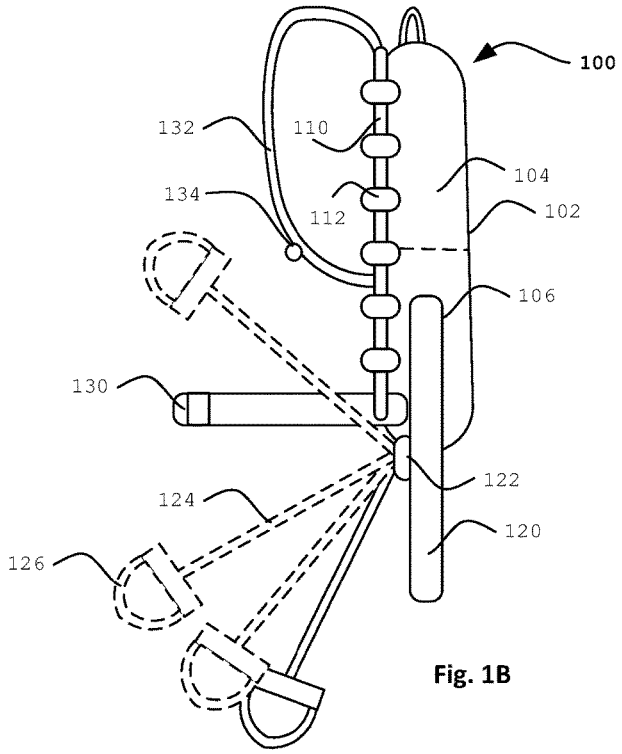
FIG. 1B is a schematic side view of the training device.

Each spool 122 may be coupled to a resistance band 124, which in turn is coupled to handles 126. The band 124 may be biased and coupled to spool 122 so that a user may pull on the handle to extend the resistance band 124. In at least some examples, the spool 122 may be used to adjust the length of resistance band 124 and lock in the band at a predetermined length. Alternatively, it will be understood that a band of a certain band may be selected from a range of bands, each having a different elasticity and/or resistance to the user. The band may be pulled by the user and expand by a certain length or proportion of the length, and may return to its unstretched length when no external force is applied thereto. In at least some examples, the degree of difficulty of the device may be altered by changing the elasticity and/or length of the band, or by modifying the spool. As shown in FIG. 1B, the spool 122 may not only be translatable up and down on the lower support member, but may also, in addition or instead, pivot on the support member to alter the angle of resistance band so that different exercises may be performed.

In use, a user may wear the training device 100 using shoulder straps or harnesses 132, and tightening belt 130 across the waist or midsection. Harnesses 132 may include two harnesses, one for each shoulder. The user may then move spool 122 to the proper position along lower support 120 and adjust its pivot angle to perform the desired exercise. In at least some examples, the exercise may include bicep curls, bench press, hammer curls, tricep kickbacks, tricep extensions, wrist curls, shoulder shrugs, shoulder press, chest fly, etc.

Figure 2A:
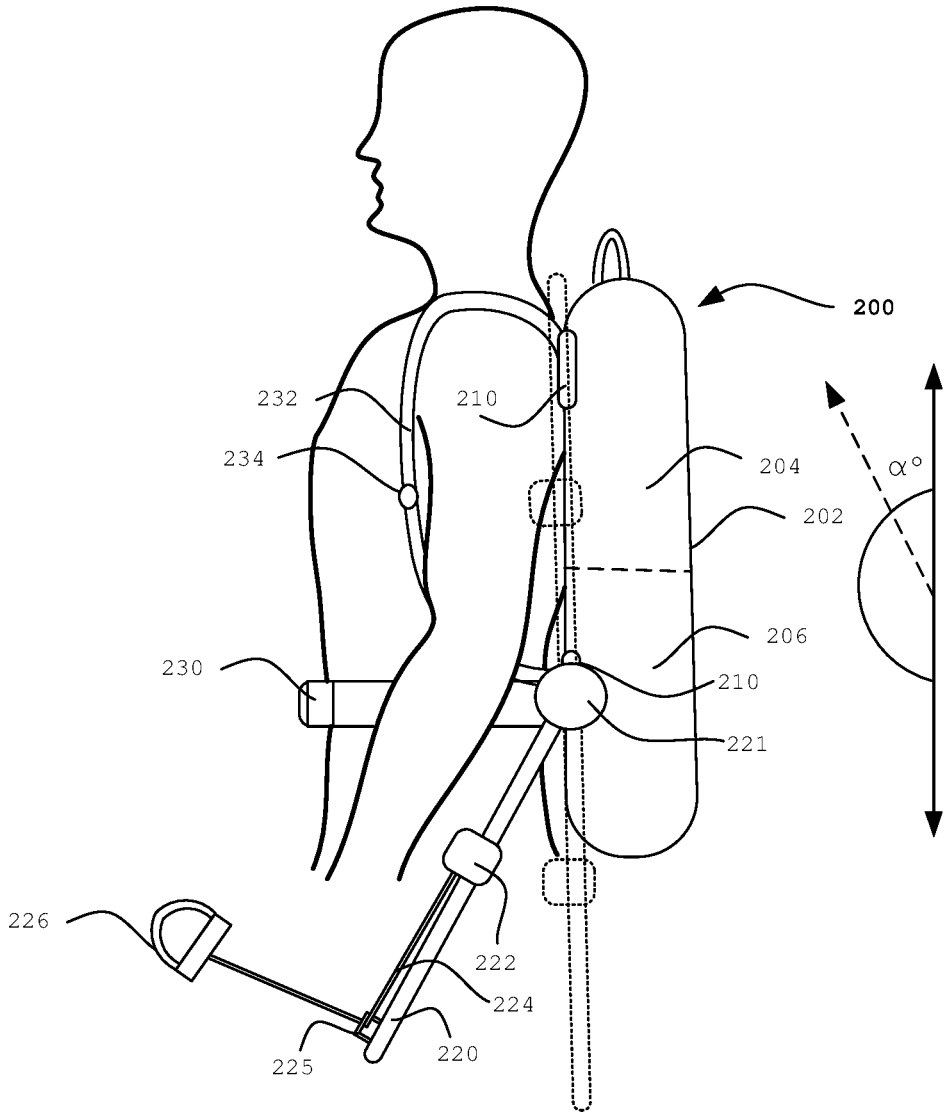
Figure 2B:
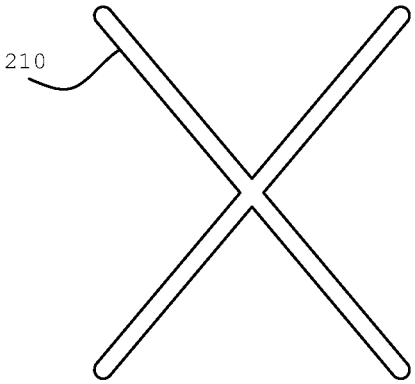
Figure 2C:
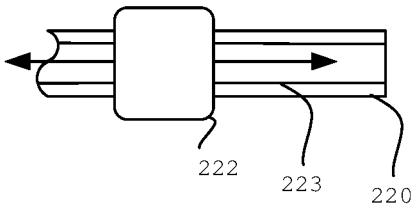

FIG. 2A illustrates a second embodiment of an exercise device 200 in the form of a wearable backpack 202. Backpack 202 may have two separate compartments including an upper storage compartment 204 and a lower hydration compartment 206 that can hold water, juice or other drinks. A pair of back braces 210 made of a metal or a rigid plastic may extend diagonally across the backpack and form an X-shaped brace (FIG. 2B). Braces 210 may be unitarily formed or otherwise coupled to one another. In at least one example, the two arms forming the X-shaped brace may pivot relatively to one another to vary its width according to the user's needs. Though not shown, free wights may be added to the braces as previously described.

Figure 2D:
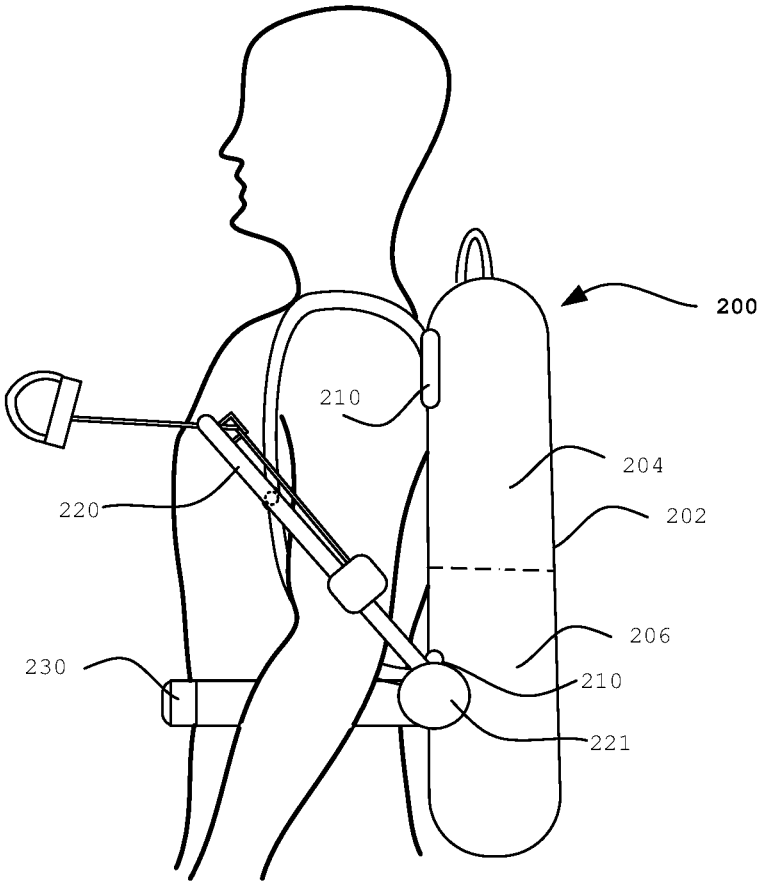

A pair of shoulder harnesses 232, and a tightening belt 230 across the waist or midsection may be used to wear the device and secured it to the user's shoulders and abdomen. Harnesses 232 may include two harnesses, one for each shoulder. Optionally, each of the two harnesses 232 may include one or more attachment points 234 for mating with portions of the lower support 220 for increasing stability of the device during use (FIG. 2D). It will be understood that male/female connectors, hoops-and-loop, coupling pins, or any suitable type of couple and decouplable connectors features may be used to couple the attachment points of the harness to a portion of the lower support 220.

Turning now to lower support member 220, it will be understood that in this embodiment, a pivot 221 may couple the lower support 220 to ends of braces 210. As shown, lower support 220 may have a range of approximately 180 degrees and may transition from a first substantially vertical position extending up toward the user's head (shown in dashed lines), to a second substantially vertical position extending down toward the user's feet (also shown in dashed lines), or be disposed anywhere within that range of motion as determined by the exercise and/or user's height. In at least some examples, the angle $\alpha$ of the lower support 200 will range from 0 degrees to 180 degrees with respect to the vertical axis.

In this example, a moveable spool 222 may be coupled to lower support members 220, the moveable spool 222 being capable of translating along a guide or channel 223 of the lower support members to various positions along the lower support member (FIG. 2B). In this example, spools 222 may be disposed along any point of lower support member and locked in place via pins or other similar techniques. In at least some examples, spools 220 may spring-loaded so that they can be wound and recapture the resistance bands when no external force is applied thereto (e.g., the resistance bands may be coiled about and/or within the spools). In at least some examples, lower support member 210 includes multiple telescoping components that adjust the length of the lower support member, and with it, the position of the spools.

Each spool 222 may be coupled to a resistance band 224, which in turn is coupled to handles 226. Optionally, U-shaped members or rings 225 may be disposed at the terminal ends of the lower supports and the resistance bands 224 may extend through the rings. The band 224 may be biased and coupled to spool 222 so that a user may pull on the handle to extend the resistance band 224. In at least some examples, the spool 222 may be used to adjust the length of resistance band 224 and lock in the band at a predetermined length. Alternatively, it will be understood that a band of a certain band may be selected from a range of bands, each having a different elasticity and/or resistance to the user. The band may be pulled by the user and expand by a certain length or proportion of the length, and may return to its unstretched length when no external force is applied thereto. In at least some examples, the degree of difficulty of the device may be altered by changing the elasticity and/or length of the band, or by modifying the spool. In at least some examples, the band and spool are formed as units of varying degrees of difficulty. For example, spool/band units may be available to provide a range of resistance between 5 to 65 lbs., and spools may be provided in increments of 5 or 10 lbs. The spool/band units may be interchangeable so that a user can increase or decrease the level of difficulty as needed by decoupling the spool and assembling another spool to the lower support.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

It will be appreciated that the various dependent claims and the features set forth therein can be combined in different ways than presented in the initial claims. It will also be appreciated that the features described in connection with individual embodiments may be shared with others of the described embodiments.

What is claimed is:

1. A training device comprising:

a backpack having a pair of shoulder straps;

a rigid backbrace having at least two arms that at least partially overlap with one another and are fixed together;

a pair of lower support members coupled to ends of the rigid backbrace; and a resistance band coupled to each of the pair of lower support members and terminating in a handle.

2. The training device of claim 1, wherein the backpack includes a first compartment for storage, and a second fluid-tight compartment for hydration.

3. The training device of claim 1, wherein the rigid backbrace is configured and arranged to accept a number of free weights.

4. The training device of claim 1, wherein the rigid backbrace includes two arms that are pivotable relative to one another.

5. The training device of claim 1, further comprising a belt coupleable to at least one of the backpack and the rigid backbrace.

6. The training device of claim 1, wherein the pair of lower supports are pivotable relative to the rigid backbrace.

7. The training device of claim 6, wherein the pair of lower supports are independently moveable relative to the rigid backbrace.

8. The training device of claim 6, wherein each of the pair of lower supports is transitionable to a first position substantially parallel with the rigid backbrace.

9. The training device of claim 8, wherein each of the pair of lower supports is transitionable to a second position substantially orthogonal to the rigid backbrace.

10. A training device comprising:

a backpack having a pair of shoulder straps;

a rigid backbrace having at least two arms;

a pair of lower support members coupled to ends of the rigid backbrace;

a resistance band coupled to each of the pair of lower support members and terminating in a handle; and attachment points disposed on the shoulder straps, the attachment points being configured and arranged to couple to portions of the lower support members.

11. A method of using a training device, comprising:

providing a backpack having a pair of shoulder straps, a rigid backbrace having at least two arms that at least partially overlap with one another and are fixed together, a pair of lower support members coupled to ends of the rigid backbrace; and coupling a resistance band to each of the pair of lower support members.

12. The method of claim 11, further comprising adjusting the two arms of the rigid backbrace relative to one another by coupling them at different locations along their length.

13. The method of claim 11, further comprising pivoting the pair of lower supports relative to the rigid backbrace.

* * * * *